US011668480B2

(12) United States Patent
Smith et al.

(10) Patent No.: US 11,668,480 B2
(45) Date of Patent: Jun. 6, 2023

(54) SLEEP ENHANCEMENT IN AN HVAC SYSTEM

(71) Applicant: Trane International Inc., Davidson, NC (US)

(72) Inventors: Christopher Blake Smith, Whitehouse, TX (US); John S. Grace, Charlotte, NC (US)

(73) Assignee: Trane International Inc., Davidson, NC (US)

( * ) Notice: Subject to any disclaimer, the term of this patent is extended or adjusted under 35 U.S.C. 154(b) by 0 days.

(21) Appl. No.: 15/699,778

(22) Filed: Sep. 8, 2017

(65) Prior Publication Data

US 2018/0073760 A1 Mar. 15, 2018

Related U.S. Application Data

(60) Provisional application No. 62/385,589, filed on Sep. 9, 2016.

(51) Int. Cl.
*F24F 11/30* (2018.01)
*F24F 11/62* (2018.01)
(Continued)

(52) U.S. Cl.
CPC ..... *F24F 11/30* (2018.01); *F24F 11/62* (2018.01); *F24F 11/66* (2018.01); *F24F 11/61* (2018.01);
(Continued)

(58) Field of Classification Search
None
See application file for complete search history.

(56) References Cited

U.S. PATENT DOCUMENTS 4,341,345 A * 7/1982 Hammer ..... F25D 29/00 236/46 R
5,167,610 A 12/1992 Kitado et al.
(Continued)

OTHER PUBLICATIONS

Boris RM Kingma, Arjan JH Frijns, Lisje Schellen & Wouter D Van Marken Lichtenbelt Beyond the classic thermoneutral zone, Temperature, 1:2, pp. 142-149 (2014).
(Continued)

*Primary Examiner* — Mohammad Ali
*Assistant Examiner* — Saad M Kabir
(74) *Attorney, Agent, or Firm* — Womble Bond Dickinson (US) LLP

(57) ABSTRACT

Improvements to an HVAC thermostat include a sleep-enhancing feature which regulates the target temperature of the HVAC system according to a temperature profile which complements the natural changes in body temperature of a person during sleep. The timing of the temperature profile is advanced to cause room temperature to decrease before the natural decrease in body temperature is expected to occur, thereby helping lead a person into sleep without the use of pharmaceuticals or other artificial sleeping aids. The temperature profile causes room temperature to increase towards the end of the sleep period, thus avoiding disruptions of sleep when body temperature is lowest or during REM stages of sleep when the human body's ability to thermoregulate is diminished. The rate of change of the target environment temperature is controlled to further enhance the quality and duration of sleep.

20 Claims, 5 Drawing Sheets

(51) Int. Cl.

| | |
|---|---|
| ***F24F 11/66*** | (2018.01) |
| *F24F 120/10* | (2018.01) |
| *F24F 11/61* | (2018.01) |
| *F24F 120/20* | (2018.01) |
| *F24F 120/14* | (2018.01) |

(52) U.S. Cl.
CPC ..... *F24F 2120/10* (2018.01); *F24F 2120/14* (2018.01); *F24F 2120/20* (2018.01)

(56) References Cited

U.S. PATENT DOCUMENTS

| | | | | |
|---|---|---|---|---|
| 5,441,476 | A | 8/1995 | Kitado et al. | |
| 6,536,675 | B1 * | 3/2003 | Pesko | F24F 13/24 165/238 |
| 6,581,403 | B2 * | 6/2003 | Whitebook | A61F 7/0085 62/434 |
| 6,825,769 | B2 | 11/2004 | Colmenarez et al. | |
| 6,838,994 | B2 | 1/2005 | Gutta et al. | |
| 7,170,404 | B2 | 1/2007 | Albert et al. | |
| 7,179,218 | B2 | 2/2007 | Raniere | |
| 7,524,279 | B2 | 4/2009 | Auphan | |
| 7,868,757 | B2 | 1/2011 | Radivojevic et al. | |
| 7,967,739 | B2 | 6/2011 | Auphan | |
| 8,348,840 | B2 | 1/2013 | Heit et al. | |
| 8,353,828 | B2 | 1/2013 | Hsu et al. | |
| 8,409,074 | B2 | 4/2013 | Arai et al. | |
| 8,543,243 | B2 | 9/2013 | Wallaert et al. | |
| 8,630,741 | B1 | 1/2014 | Matsuoka et al. | |
| 8,654,974 | B2 | 2/2014 | Anderson et al. | |
| 8,768,520 | B2 | 7/2014 | Dexman et al. | |
| 8,781,568 | B2 | 7/2014 | Dugan et al. | |
| 8,893,032 | B2 | 11/2014 | Bruck et al. | |
| 8,955,337 | B2 | 2/2015 | Parish et al. | |
| 8,994,540 | B2 | 3/2015 | Fadell et al. | |
| 9,007,222 | B2 | 4/2015 | Mittleman et al. | |
| 9,046,414 | B2 | 6/2015 | Fadell et al. | |
| 9,069,380 | B2 | 6/2015 | Rahman et al. | |
| 9,146,041 | B2 | 9/2015 | Novotny et al. | |
| 9,175,868 | B2 | 11/2015 | Fadell et al. | |
| 9,189,751 | B2 | 11/2015 | Matsuoka et al. | |
| 9,234,668 | B2 | 1/2016 | Fadell et al. | |
| 9,291,359 | B2 | 3/2016 | Fadell et al. | |
| 9,429,962 | B2 | 8/2016 | Matsuoka | |
| 9,513,642 | B2 | 12/2016 | Rogers et al. | |
| 9,520,252 | B2 | 12/2016 | Mittleman et al. | |
| 9,536,449 | B2 | 1/2017 | Connor | |
| 9,582,072 | B2 | 2/2017 | Connor | |
| 9,607,787 | B2 | 3/2017 | Mittleman et al. | |
| 9,675,281 | B2 | 6/2017 | Arnold et al. | |
| 9,740,385 | B2 | 8/2017 | Fadell et al. | |
| 9,791,839 | B2 | 10/2017 | Matsuoka et al. | |
| 9,851,728 | B2 | 12/2017 | Matsuoka et al. | |
| 2002/0151992 | A1 | 10/2002 | Hoffberg et al. | |
| 2005/0119766 | A1 | 6/2005 | Amundson et al. | |
| 2008/0058740 | A1 | 3/2008 | Sullivan et al. | |
| 2010/0204764 | A1 | 8/2010 | Garetz | |
| 2011/0010014 | A1 * | 1/2011 | Oexman | A47C 27/082 600/301 |
| 2011/0015495 | A1 | 1/2011 | Dothie et al. | |
| 2012/0092171 | A1 | 4/2012 | Hwang et al. | |
| 2012/0210513 | A1 | 8/2012 | Chestakov et al. | |
| 2014/0031990 | A1 | 1/2014 | Filbeck | |
| 2015/0100167 | A1 | 4/2015 | Sloo et al. | |
| 2015/0228419 | A1 | 8/2015 | Fadell et al. | |
| 2016/0136385 | A1 * | 5/2016 | Scorcioni | A47C 21/044 600/26 |
| 2017/0146261 | A1 | 5/2017 | Rogers et al. | |

OTHER PUBLICATIONS

Greg Kelly, ND, Body Temperature Variability (Part 1): A Review of the History of Body Temperature and its Variability Due to Site Selection, Biological Rhythms, Fitness, and Aging, Alternative Medicine Review 11:4, pp. 278-293 (2016).

Harvey R. Colten and Bruce M. Altevogt, Sleep Disorders and Sleep Deprivation: An Unmet Public Health Problem, ISBN: 0-309-65727-X, (2006).

Éva Szentirmai and Levente Kapás, Intact brown adipose tissue thermogenesis is required for restorative sleep responses after sleep loss, European Journal of Neuroscience vol. 39, pp. 984-998 (2014).

J.A. Sarabia, M.A. Rol, P. Mendiola, J.A. Madrid, Circadian rhythm of wrist temperature in normal-living subjects A candidate of new index of the circadian system, Physiology & Behavior 95 pp. 570-580 (2008).

Nico Romeijn, MSc; Ilse M. Verweij, MSc; Anne Koeleman, MSc; Anne Mooij, MSc; Rosa Steimke, MSc; Jussi Virkkala, PhD; Ysbrand Van Der Werf, PhD; Eus J.W. Van Someren, PhD, Cold Hands, Warm Feet: Sleep Deprivation Disrupts Thermoregulation and Its Association with Vigilance, SLEEP, vol. 35, No. 12 pp. 1673-1683 (2012).

Rolf Fronczek, MSc; Roy J.E.M. Raymann, MSc; Nico Romeijn, MSc; Sebastiaan Overeem, MD, PhD; Maria Fischer; J. Gert Van Dijk, MD, PhD; Gert Jan Lammers, MD, PhD; Eus J.W. Van Someren, PhD, Manipulation of Core Body and Skin Temperature Improves Vigilance and Maintenance of Wakefulness in Narcolepsy, SLEEP, vol. 31, No. 2, pp. 233-240 (2008).

Kazue Okamoto-Mizuno and Koh Mizuno, Effects of thermal environment on sleep and circadian rhythm, Journal of Physiological Anthropology, 31:14 (2012).

Yanfeng Liu, Cong Song, Yingying Wang, Dengjia Wang, Jiaping Liu, Experimental study and evaluation of the thermal environment for sleeping, Building and Environment 82, pp. 546-555 (2014).

Li Lan, Li Pan, Zhiwei Lian, Hongyuan Huang, Yanbing Lin, Experimental study on thermal comfort of sleeping people at different air temperatures, Building and Environment 73 pp. 24-31 (2014).

Md. Dilshad Manzar, Mani Sethi and M. Ejaz Hussain, Humidity and sleep: a review on thermal aspect, Biological Rhythm Research vol. 43, No. 4, pp. 439-457, (Aug. 2012).

Fumiharu Togo, PhD; Seika Aizawa, PhD; Jun-Ichiro Arai, PhD; Shoko Yoshikawa, MEng; Takayuki Ishiwata, PhD; Roy J. Shephard, MD, PhD, DPE, LLD (Hon Caus); Yukitoshi Aoyagi, PhD, Influence on Human Sleep Patterns of Lowering and Delaying the Minimum Core Body Temperature by Slow Changes in the Thermal Environment, SLEEP, vol. 30, No. 6, pp. 797-802 (2007).

R Fronczek, R J E M Raymann, S Overeem, N Romeijn, J G Van Dijk, G J Lammers and E J W Van Someren, Manipulation of skin temperature improves nocturnal sleep in narcolepsy, J Neurol Neurosurg Psychiatry, 79:1354-1358 (2008).

Eus J.W. Van Someren, Mechanisms and functions of coupling between sleep and temperature rhythms, Progress in Brain Research, vol. 153, Ch. 18 (2006).

Eus J.W. Van Someren, Modelling the relation of body temperature and sleep: importance of the circadian rhythm in skin temperature, Netherlands Institute For Brain Research, Amsterdam, pp. 153-157 (undated).

Masayuki Kondo, Hiromi Tokura, Tomoko Wakamura, Ki-Ja Hyun, Satoshi Tamotsu, Takeshi Morita and Tadashi Oishi, Physiological Significance of Cyclic Changes in Room Temperature around Dusk and Dawn for Circadian Rhythms of Core and Skin Temperature, Urinary 6-hydroxymelatonin Sulfate, and Waking Sensation just after Rising, J Physiol Anthropol 26(4) pp. 429-436 (2007).

Steven M. Frank, Srinivasa N. Raja, Christian F. Bulcao, and David S. Goldstein, Relative contribution of core and cutaneous temperatures to thermal comfort and autonomic responses in humans, J. Appl. Physiol. 86(5): pp. 1588-159 (1999).

Roy J. E. M.Raymann, Dick F. Swaab and Eus J.W.Van Someren, Skin deep: enhanced sleep depth by cutaneous temperature manipulation, Brain, 131, 500-513 (2008).

Roy J.E.M. Raymann, Dick F. Swaab, and Eus J.W. Van Someren, Skin temperature and sleep-onset latency: Changes with age and insomnia, Physiology & Behavior 90:257-266 (2007).

(56) References Cited

OTHER PUBLICATIONS

Chris Leung, Hua Ge, Sleep thermal comfort and the energy saving potential due to reduced indoor operative temperature during sleep, Building and Environment 59:91-98 (2013).
Nico Romeijn, Roy J. E. M. Raymann, Els Møst & Bart Te Lindert, Wisse P. Van Der Meijden, Rolf Fronczek, German Gomez-Herrero and Eus J. W. Van Someren, Sleep, vigilance, and thermosensitivity, Eur J Physiol 463:169-176 (2012.
Michael Boduch and Warren Fincher, Standards of Human Comfort: Relative and Absolute, UTSoA—Meadows Seminar Fall (2009).
Hisako Fujii A, Sanaefukuda, Daisuke Narumi, Tomohiko Ihara, Yasuyoshi Watanabe, Fatigue and sleep under large summer temperature differences, Environmental Research 138 pp. 17-21 (2015).
Kurt Kräuchi, The human sleep-wake cycle reconsidered from a thermoregulatory point of view, Physiology & Behavior 90 pp. 236-245 (2007).
Zachary J Schlader, The human thermoneutral and thermal comfort zones: Thermal comfort in your own skin blood flow, Temperature 2:1 pp. 47-48 (2015).
Leon C. Lacka, Michael Gradisar, Eus J.W. Van Someren, Helen R. Wright, and Kurt Lushington, The relationship between insomnia and body temperatures. Sleep Medicine Reviews 12, 307-317 (2008).
Judith Barrett, Leon Lack and Mary Morris, The Sleep-Evoked Decrease of Body Temperature, Sleep, 16(2) pp. 93-99 (1993).
Yu Hibino, Shuichi Hokoi, Katsuaki Yoshida, Satoru Takada, Masanori Nakajima, and Miho Yamate, Thermal physiological response to local heating and cooling during sleep, Frontiers of Architectural Research 1, pp. 51-57 (2012).
Gree Crown High-Wall Ductless Air Conditioning & Heating System Owner's Manual (2015).
LG Single Zone High Efficiency & Standard Wall Mounted Owner's Manual (2015).
Mitsubishi Electric Split-Type Air Conditioners Indoor Unit Operating Instructions (2013).
Ramsond Instruction & Installation Manual Ductless Mini Split Air Conditioning Systems (2013).

* cited by examiner

SLEEP ENHANCEMENT IN AN HVAC SYSTEM

CROSS-REFERENCE TO RELATED APPLICATION

This application claims the benefit of and priority to U.S. Provisional Application Ser. No. 62/385,589 entitled "SLEEP ENHANCEMENT IN AN HVAC SYSTEM" and filed Sep. 9, 2016, the entirety of which is hereby incorporated by reference herein for all purposes.

BACKGROUND

1. Technical Field

The present disclosure is directed to HVAC controllers, and in particular, to an improved HVAC thermostat that provides an altered temperature environment that enhances a person's sleep.

2. Background of Related Art

Heating, ventilation, and air conditioning (HVAC) systems are typically controlled by a thermostat mounted on a wall that enables occupants to set the desired temperature in the building. In summer months, the thermostat can be placed in a cooling mode to operate air conditioning equipment, while in the winter months the thermostat can be placed in a heating mode to operate an oil- or gas-fired furnace, an electric heater, or a heat pump. Many thermostats include an energy-saving scheduling function to enable automatic adjustments of temperature based on time-of-day, day-of-week, or even seasonally. Some thermostats include occupancy sensing functions that reduce system output during periods when no people are present in the building.

Increasingly, the stresses and habits of modern life negatively impact a person's sleep. People who heavily rely on cell phones exhibit an increase in sleep disorders and depressive symptoms. Habitual late night computer, smart phone, and tablet use is associated with sleep disorders, stress and depressive symptoms, and loss of efficiency during waking hours. Consequently, many people are increasingly unable to achieve the duration and quality of sleep that they need.

Some thermostats and HVACs include a nighttime "sleep" setback mode, which simply lowers (during winter) or raises (during summer) the setpoint temperature during sleeping hours to save energy. One drawback of such simple nighttime setback modes is that they disrupt a person's circadian rhythms and can impair both the duration and quality of sleep. A thermostat which enhances a person's sleep in an effective and easy-to-use manner would be a welcome advance.

SUMMARY

In one aspect, the present disclosure is directed to a sleep-enhancing method of operating an HVAC system. The method includes determining the onset of a sleep time period and decreasing the target temperature of the HVAC system according to a temperature profile that emulates the change in body temperature of a human being during sleep. In embodiments, the method includes increasing the target temperature of the HVAC system prior to the end of the sleep time period. In embodiments, the method further enhances sleep by commencing the lowering prior to the onset of the sleep time period to cause the temperature profile to lead the change in body temperature of a human being during the sleep time period. In embodiments, the temperature profile defines a plurality of consecutive sub-periods. In embodiments, during a first sub-period the target temperature decreases at a first rate. In embodiments, during a second sub-period, the target temperature decreases at a second rate. In embodiments, during a third sub-period, the target temperature remains unchanged. In embodiments, during a fourth sub-period, the target temperature increases at a third rate. In embodiments, the determining is based on a schedule and/or an occupancy. In embodiments, the rate of change of the target temperature of the HVAC system is no more than about 0.025° C. per minute.

In another aspect, the present disclosure is directed to sleep-enhancing controller for an HVAC system. In embodiments, the controller includes a wall-mounted thermostat. In embodiments, the controller includes a temperature sensor interface, an HVAC control interface, a processor in operative communication with the temperature sensor interface and the HVAC control interface, and a memory in operative communication with the processor. The memory includes instructions, which, when executed by the processor, cause the sleep-enhancing controller to determine the onset of a sleep time period and decrease the target temperature of the HVAC system according to a temperature profile that emulates the change in body temperature of a human being during sleep. In embodiments, the instructions further cause the sleep-enhancing controller to raise the target temperature of the HVAC system prior to the end of the sleep time period. In embodiments, the instructions further cause the controller to commence lowering the target temperature prior to the onset of the sleep time period to cause the temperature profile to lead the change in body temperature of a human being during the sleep time period. In embodiments, during a first portion of the sleep time period, the instructions cause the controller to decrease the target temperature at a first rate. In embodiments, during a second portion of the sleep time period, the instructions cause the controller to decrease the target temperature at a second rate. In embodiments, during a third portion of the sleep time period, the instructions cause the controller to maintain the target temperature unchanged. In embodiments, during a fourth portion of the sleep time period, the instructions cause the controller to increase the target temperature at a third rate. In embodiments, the instructions further cause the controller to determine the onset of the sleep time period based on a predetermined sleep schedule. In embodiments, the controller includes an occupancy sensor interface in operable communication with the processor and wherein the instructions further cause the controller to determine an occupancy state based on a signal received from the occupancy sensor interface and to determine the onset of the sleep time period in response to the occupancy state. In embodiments, the instructions further cause the controller to limit the rate of change of the target temperature of the HVAC system to no more than about 0.025° C. per minute.

BRIEF DESCRIPTION OF THE DRAWINGS

Various embodiments of the disclosed system and method are described herein with reference to the drawings wherein.

Figure 1:
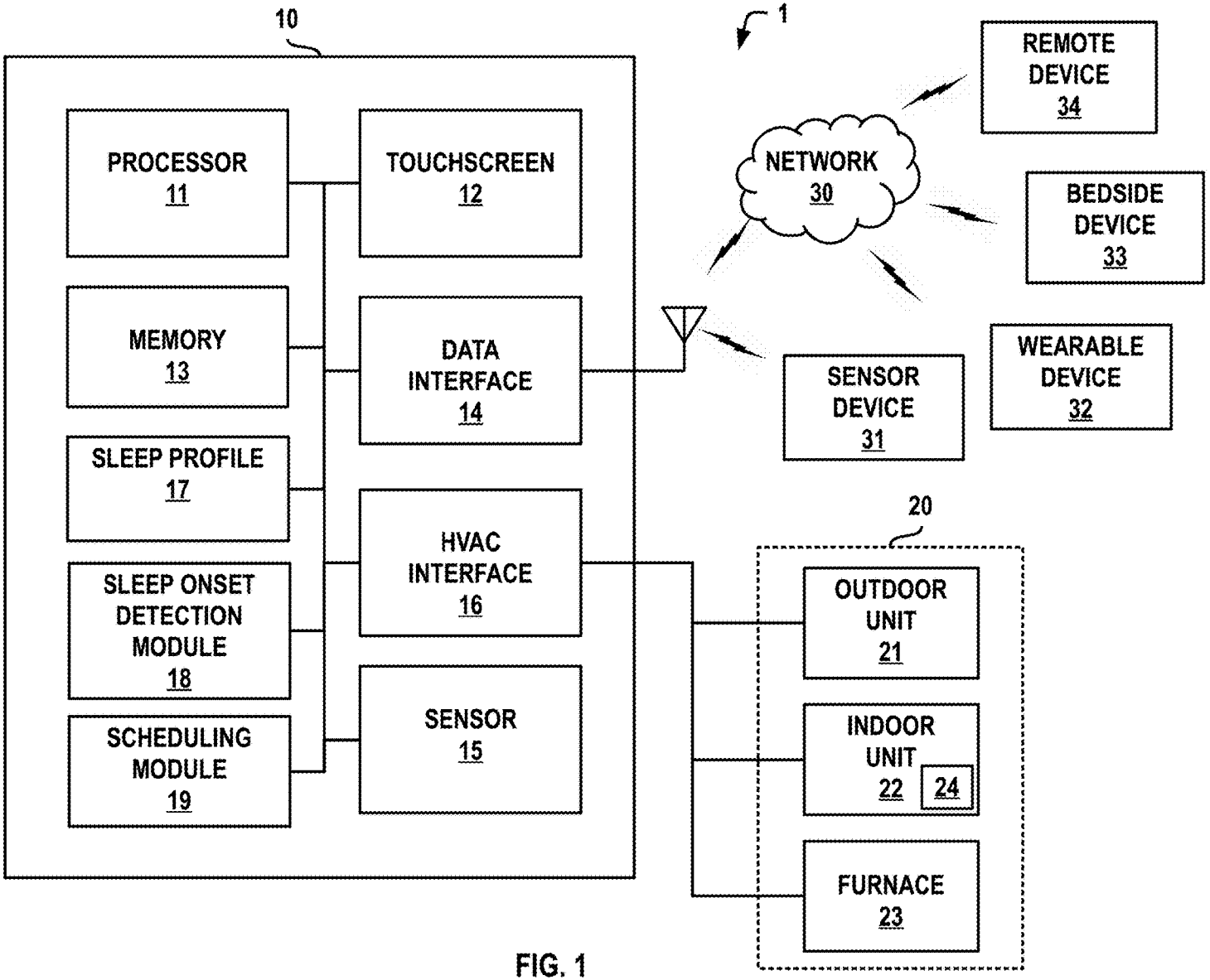
FIG. 1 is a block diagram of an embodiment of an HVAC system having a sleep-enhancing thermostat in accordance with the present disclosure.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. Well-known functions or constructions and repetitive matter are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in any appropriately detailed structure. In this description, as well as in the drawings, like-referenced numbers represent elements which may perform the same, similar, or equivalent functions. The word "exemplary" is used herein to mean "serving as a non-limiting example, instance, or illustration." Any embodiment described herein as "exemplary" is not necessarily to be construed as preferred or advantageous over other embodiments. The word "example" may be used interchangeably with the term "exemplary."

Aspects of the present disclosure are described herein in terms of functional block components and various processing steps. It should be appreciated that such functional blocks configured to perform the specified functions may be embodied in mechanical devices, electromechanical devices, analog circuitry, digital circuitry, and/or modules embodied in a computer. For example, the present disclosure may employ various discrete components, integrated circuit components (e.g., memory elements, processing elements, logic elements, look-up tables, and the like) which may carry out a variety of functions, whether independently, in cooperation with one or more other components, and/or under the control of one or more processors or other control devices. It should be appreciated that the particular implementations described herein are illustrative of the disclosure and its best mode and are not intended to otherwise limit the scope of the present disclosure in any way. One skilled in the art will also appreciate that, for security reasons, any element of the present disclosure may consist of any combination of databases or components at a single location or at multiple locations, wherein each database or system includes any of various suitable security features, such as firewalls, access codes, authentication, encryption, de-encryption, compression, decompression, and/or the like. It should be understood that the steps recited herein may be executed in any order and are not limited to the order presented. Moreover, two or more steps or actions recited herein may be performed concurrently.

In one aspect, the present disclosure is directed to a sleep-enhancing HVAC thermostat and related systems and methods for inducing and improving sleep of a person in the temperature-controlled environment. Aspects of the present disclosure utilize techniques which emulate a human body's natural temperature decline at the onset of, and during, sleep. The technique causes the controlled environment temperature to emulate the rate and timing of the body's natural decline in temperature, and, in a related aspect, the timing of the environmental temperature change leads the body's natural temperature changes, which further helps induce and maintain sleep. In a related aspect of the present disclosure, the temperature of the environment is increased at the end of the sleep period when the body is at its coldest, which further helps avoid disruption of natural sleep patterns that occur towards the end of the sleep period. In another aspect of the present disclosure, the rate of change of the environment temperature is limited to no more than the rate that will wake a sleeping person, which has been determined to be no more than 0.025° C./minute or 2.7° F./hour. In yet another aspect of the present disclosure, the thermostat and related systems and methods include determining the onset of a sleep period via a scheduled sleep time, receipt of a user input, by utilizing current and historical environmental sensor inputs such as motion, occupancy, and $CO_2$ levels, and/or by utilizing current and historical physiological sensor inputs such as heart rate, body temperature, skin temperature, blood pressure, respiration rate, blood oxygen ($SpO_2$), and galvanic skin resistance.

In more detail, and with reference to FIG. 1, an example embodiment of an HVAC system 1 having a sleep-enhancing thermostat 10 is shown. Thermostat 10 includes, in operative communication, processor 11, touchscreen 12, memory 13, data interface 14, one or more sensors 15, and HVAC interface 16. Sensor 15 may include a temperature sensor, humidity sensor, light sensor, proximity sensor, thermal imaging sensor such as an infrared sensor, and/or a motion sensor. HVAC interface 16 is configured to communicatively couple thermostat 10 with HVAC equipment 20. HVAC equipment 20 may include, without limitation, an outdoor unit 21, an indoor unit 22, and/or a furnace 23 which provide conditioned air, e.g., heated, cooled, or dehumidified air, to the controlled indoor environment of the home. Data interface 14 is configured to communicably couple thermostat 10 with other devices, including without limitation a sensor device 31, a wearable device 32, a bedside device 33, and/or a remote device 34.

Data interface 14 is configured to communicate using one or more of a wireless communication protocol, such as without limitation, any variant of IEEE 802.11 (commonly known as WiFi), variants of IEEE 802.15 wireless personal area networking such as Bluetooth® and Z-Wave®, and other wireless standards such as ZigBee®. Data interface 14 may be additionally or alternatively be configured to communicate using a wired protocol using dedicated data lines (e.g., Ethernet) or via powerline communication links using, for example, IEEE 1901, X10® and/or Insteon® protocol.

Data interface 14 may be additionally or alternatively be configured to communicate using a wide area cellular mobile network using, for example and without limitation, a GSM protocol (3G, 4G, LTE etc.), a CDMA protocol (EV-DO, SV-DO, etc.), and so forth. In embodiments, data interface 14 is configured as a WiFi hot-spot or wired router to enable thermostat 10 to provide internet access via the cellular data network to other internet-enabled devices within the home, such as computers, notebooks, mobile devices, streaming media devices, security devices, appliances, and so forth.

HVAC interface 16 is configured to communicate between thermostat 10 and HVAC equipment 20 using any communications protocol suitable for use with HVAC equipment 20. For example, and without limitation, where indoor unit 21, outdoor unit 22, and/or furnace 23 employ single- or dual-speed motors, HVAC interface 16 may include a 24V switched circuit interface which operates with well-known HVAC color-coded wiring schemes (Rc, Rh, C, Y, W, Y2, W2, etc.). Where indoor unit 21 and/or outdoor unit 22 employ variable-speed motors, HVAC interface 16 may include a digital signaling interface such as, without limitation, CAN bus, RS-485, ComfortLink II™ ClimateTalk™, and the like. In embodiments, HVAC interface 16 may operate using both 24V switched circuits and digital signaling protocols to flexibly accommodate any combination of HVAC equipment. In embodiments, any of the functions of data interface 14 may be performed by HVAC interface 16, and vice versa. In embodiments, HVAC interface 16 may be incorporated within data interface 14.

Thermostat 10 is configured for communication with one or more remote devices 34 via network 30 (which may include a LAN, Z-Wave® or ZigBee® mesh network, and/or the public internet). Remote device 34 may include, without limitation, a mobile device, smart phone, a tablet, a notebook computer, a desktop computer, smart TV, and/or a touchscreen device.

In some embodiments, outdoor unit 21 and indoor unit 22 may be configured as a split HVAC system wherein outdoor unit 21 is configured as an air conditioner or heat pump unit, and indoor unit 22 is configured as an air handling unit. In other embodiments, outdoor unit 21 and indoor unit 22 may be included in a packaged system which shares a common enclosure. In some embodiments, outdoor unit 21 and/or indoor unit 22 may include an auxiliary heater 24 for use when a heat pump alone is insufficient to meet the heating demand of the home. Furnace 23 and/or auxiliary heater 24 provide heat via combustion and/or resistive electrical elements.

Thermostat 10 includes a sleep profile 17, a sleep onset determination module 18, and a scheduling module 19. As will be appreciated by one of ordinary skill in the art, aspects of the present disclosure, including but not limited to sleep profile 17, sleep onset determination module 18, and scheduling module 19, may take the form of an entirely software embodiment, an entirely hardware embodiment, or an embodiment combining both software and hardware. Embodiments may take the form of a computer program product on any suitable non-transitory computer-readable storage medium having computer-readable program code embodied in the storage medium. Any suitable computer-readable storage medium may be utilized, including semiconductor storage devices, e.g., mask ROM, EEPROM, flash memory, USB thumb drives, and the like. Computer program instructions embodying the present disclosure may be stored in memory 13 or other computer-readable memory that can direct processor 11, a computer, or other programmable data processing apparatus to function in a particular manner, such that the instructions stored in the computer-readable memory produce an article of manufacture, including instruction means, that implement the functions described herein.

Sensor device 31 incorporates one or more sensors that are configured to sense a property of the controlled environment. In an embodiment, sensor device 31 includes one or more of a motion detector, an occupancy detector, a temperature sensor, a humidity sensor, light sensor, or a $CO_2$ sensor. The sensed property is communicated to sleep onset detection module 18, which monitors any one, some, or all of these properties to assess the level of human activity within the controlled environment to determine the onset of sleep. By monitoring motion sensing, occupancy, and/or $CO_2$ levels in the controlled environment, sleep onset detection module 18 determines the sleeping habits of the home's occupants. For example, where sensor device 31 detects an absence of motion in conjunction with a decrease in CO2, sleep onset detection module 18 determines that a sleep period has begun, which, in turn, begins execution of sleep profile 17.

Scheduling module 19 stores one or more schedules which enable thermostat 10 to vary setpoint temperature at pre-programmed times. In a typical embodiment, includes the capability of following a different schedule based upon day of week, for example, a weekday schedule and a weekend schedule may be stored in scheduling module 19. Each schedule includes a plurality of time/temperature setpoint entries which define the time at which the associated temperature setpoint is active. A schedule may be predefined and/or may be editable by a user as desired. In an embodiment, scheduling module 19 includes a time/temperature entry for morning (wake-up), day (at work), evening (dinnertime) and night (sleep time). The night/sleep time entry may, in some embodiments, be configured to act as a sleep onset event, which is communicated to sleep onset determination module 18 to trigger the execution of sleep profile 17. Preferably, thermostat 10 is configured to allow sleep onset determination module 18 to trigger the execution of sleep profile 17 in advance of the night/sleep time entry to enable sleep profile 17 to lead the user into sleep. In embodiments, thermostat 10 is configured to trigger execution of sleep profile 17 two hours prior to the scheduled night/sleep time.

Sleep onset determination module 18 may additionally or alternatively receive user physiological parameters from a wearable device 32 worn by a user. Such user physiological parameters include, without limitation, heart rate, body temperature, skin temperature, blood pressure, respiration rate, blood oxygen (SpO2), and/or galvanic skin resistance. Any one, some or all of the user physiological parameters are transmitted by wearable device 32 to sleep onset detection module 18, which, in turn, determines the onset of sleep based on the one or more received user physiological parameters. For example, if a decrease in respiration rate is detected alone or in conjunction with a decrease in body temperature, a sleep onset event is deemed to have occurred and sleep onset determination module 18 causes execution of sleep profile 17 to commence.

In embodiments where HVAC system 1 includes a plurality of sensor devices 31 placed throughout the controlled environment, environmental parameters from throughout the environment are utilized to detect and predict the onset of sleep. For example, if a family typically gathers in the living room after dinner for three hours before going to sleep, environmental parameters consistent with this activity will be detected by the living room sensor device 31 (e.g., raised $CO_2$ levels, limited motion detected). If this pattern is repeated over several days, sleep onset detection module 18 will begin execution of sleep profile 17 at the observed time, e.g., three hours after raised $CO_2$ levels and limited motion is detected at living room sensor device 31. In some embodiments, sleep onset detection module 18 will begin execution of sleep profile 17 prior to the observed time, e.g., two hours before the predicted sleep time, to lead the users into sleep.

In embodiments, HVAC system 1 includes a plurality of wearable devices 32, each worn by an individual user, that are in communication with sleep onset detection module 18. In these embodiments, sleep onset detection module 18 monitors the current and historical physiological data of each individual user to determine the onset of sleep of each user, and/or to record and predict the desired sleep time of each user. In embodiments, wearable device 32 includes a unique electronic identifier that is communicated to sleep onset detection module 18. Thermostat 10 may commence the execution of sleep profile 17 based on a compromise sleep onset time (e.g., the mean bedtime of the plurality of individual users). In embodiments where HVAC system 1 includes multiple zone capability, or, for example, the ability to independently adjust the temperature of each bedroom, multiple sleep profiles may be executed concurrently to accommodate the sleep schedules of individual occupants.

Figure 2A:
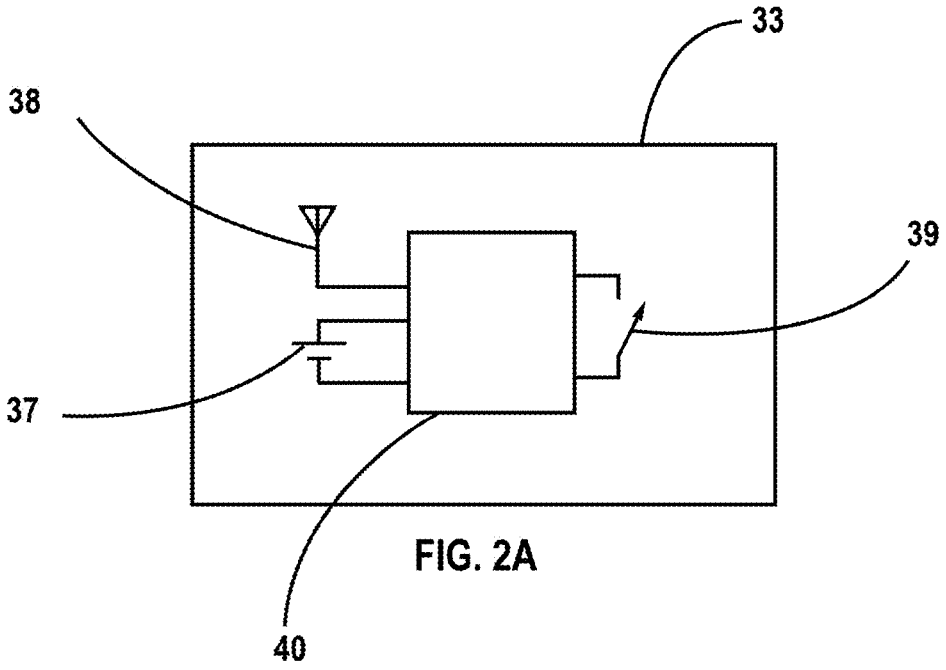
FIGS. 2A and 2B illustrates a bedside device in accordance with an embodiment of the present disclosure.
Figure 2B:
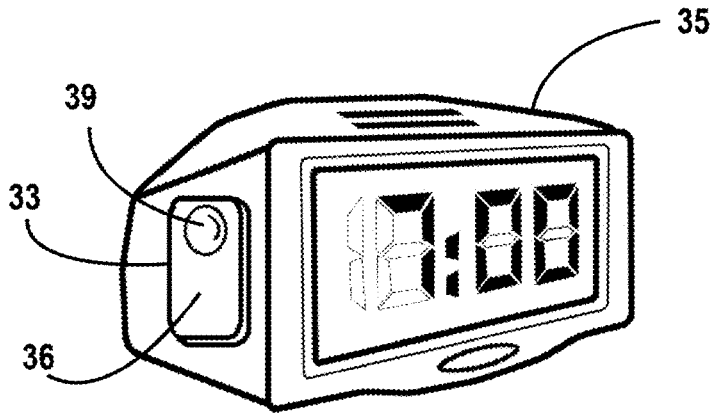

HVAC system 1 additionally or alternatively includes a bedside device 33 that, in the example embodiment illustrated in FIGS. 2A and 2B, is configured for attachment to an alarm clock 35, nightstand, lamp, lampshade, or other bedside object capable of providing a suitable mounting surface for bedside device 29. Bedside device 33 includes a housing 36, power source 37, antenna 38, and an actuator 39, such as without limitation, a pushbutton. Actuator 39, power source 37, and antenna 38 are communicatively coupled to a transmitter 40. In use, when a user is ready to turn in for sleep, the user presses actuator 39 which causes transmitter 40 to transmit a sleep onset signal to thermostat 10 and sleep onset determination module 18 to indicate a sleep onset event has occurred. In embodiments, bedside device 33 is configured for attachment to the bed, e.g., mattress, box spring, and/or bedframe to sense the presence of an occupant in the bed by measuring weight, pressure, motion, vibrations and/or sensing changes thereof.

Upon detection of a sleep onset event, sleep onset determination module 18 causes execution of sleep profile 17 to commence, and, in embodiments, records the sleep onset event as part of a learning process. The sleep onset event may be represented by data items such as time of event, date, and day-of-week. A sequence number and/or a unique electronic identifier may be recorded which enumerates and/or distinguishes the instant sleep onset event among a plurality of sleep onset events recorded in a given evening. This enables, for example, thermostat 10 to monitor different residents of the household who may go to bed at different times.

Figure 3:
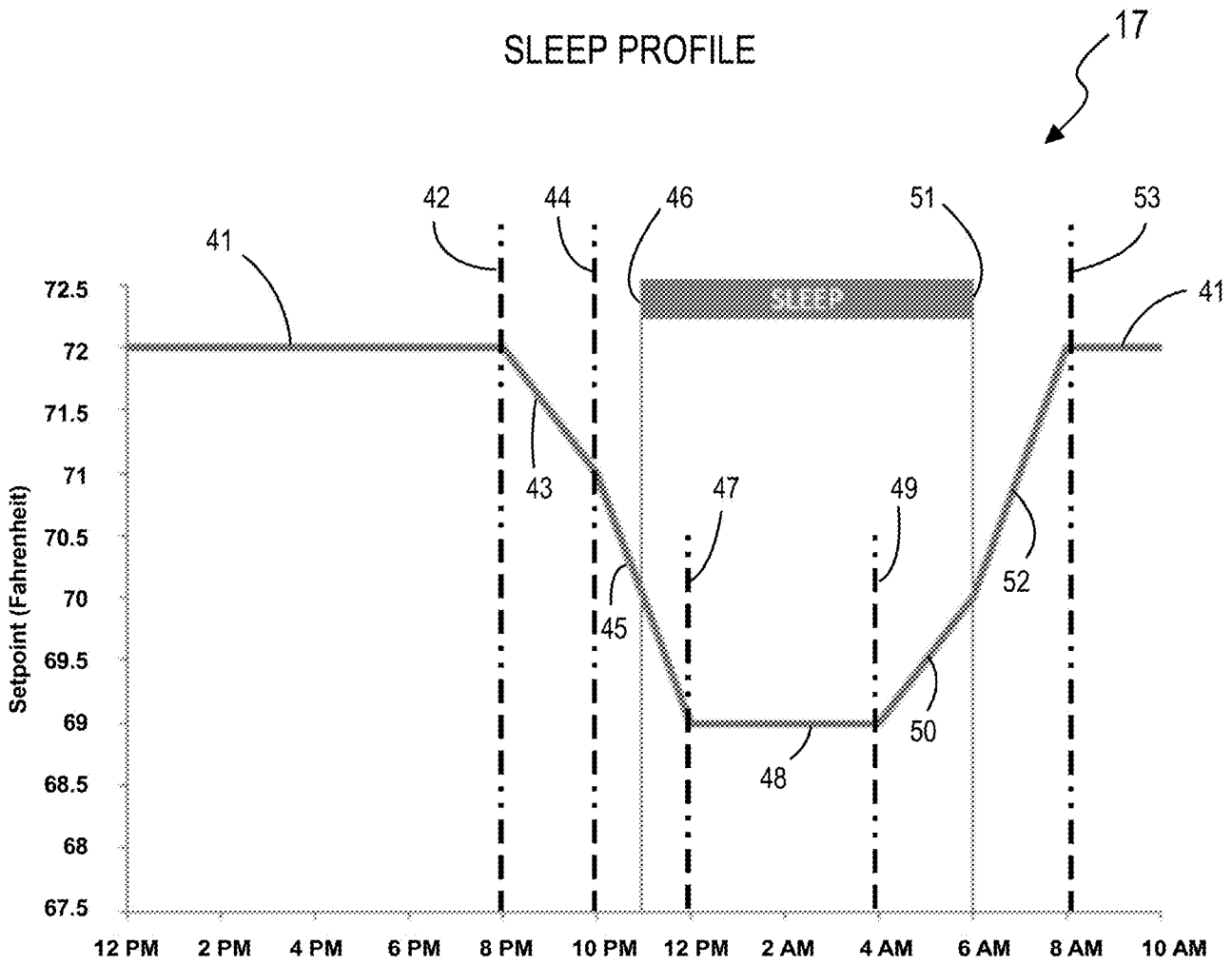
FIG. 3 illustrates a sleep profile in accordance with an embodiment of the present disclosure.

As shown in FIG. 3, an exemplary sleep profile 17 in accordance with the present disclosure defines a series of sleep-enhancing setpoint temperature alterations. In the FIG. 3 example, the base setpoint 41 is shown to be 72° F. Typically, this would represent the preferred temperature set by the user. The targeted sleep duration is seven hours, between the hours or 11:00 PM (point 46) and 6:00 AM (point 51). Sleep profile 17 begins execution at point 42 which, in the present example occurs at 8:00 PM. Note that, in the present example, the execution of sleep profile 17 leads the time of the desired onset of sleep 46, e.g., 11:00 PM, by three hours.

Upon initial execution, sleep profile 17 enters a first temperature decreasing portion 43 wherein the setpoint temperature is decreased 1.0° F. over the course of two hours, e.g., the setpoint is changed at a rate of about −0.5° F./hour. In the present example, the setpoint reaches 71° F. at 10:00 PM (point 44). At point 44, a second temperature decreasing portion 45 is entered during which the rate of setpoint decrease accelerates to about −1.0° F./hour for a period of two hours e.g., about twice the rate of the first temperature decreasing portion. Note that in the present example, the desired onset of sleep 46 occurs approximately halfway though second temperature decreasing portion 45, e.g., at 11:00 PM. When the second temperature decreasing portion 45 is completed, at point 47 a temperature sustaining portion 48 is entered where the setpoint is held unchanged for four hours. As shown in the FIG. 3 example, the setpoint during the temperature sustaining portion 48 is held at a temperature 3° F. cooler than the base setpoint temperature, e.g., at 69° F. It should be understood that the duration of temperature sustaining portion 48 may be adjusted, e.g., longer or shorter than four hours, depending at least in part upon the desired targeted sleep duration.

At point 49 a first temperature increasing portion 50 is entered during which the setpoint temperature is increased 1.0° F. over the course of two hours, e.g., the setpoint is changed at a rate of about +0.5° F./hour. Note that point 49 occurs two hours prior to point 51, the end of the target sleep period. At point 51, a second temperature increasing portion 52 is entered during which the rate of setpoint decrease accelerates to about +1.0° F./hour for a period of two hours, e.g., about twice the rate of the first temperature increasing portion. At point 53, or 8:00 AM, the setpoint has reached the original base setpoint 41 of 72° F., and the sleep profile concludes.

Figure 4:
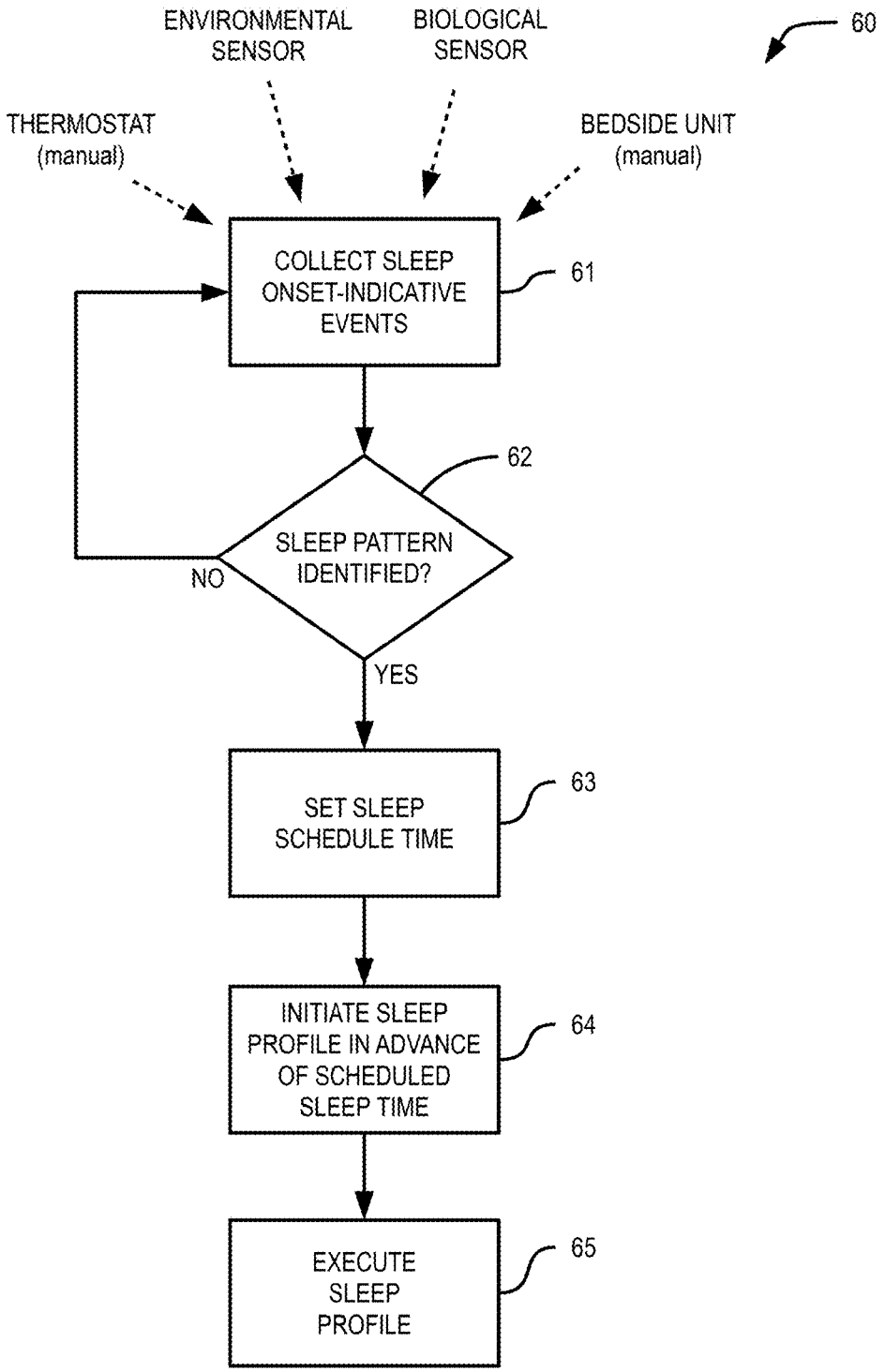
FIG. 4 is a flowchart illustrating a method of sleep enhancement in an HVAC system in accordance with the present disclosure.

Turning to FIG. 4, an example embodiment of a sleep-enhancing method of operating an HVAC system 60 is shown. At block 61, events that are indicative of sleep onset are collected from one or more sources, such as, without limitation, a manual sleep mode selection made at a wall-mounted thermostat (FIG. 5) or a bedside unit, one or more environmental parameters derived from an environmental sensor, and/or one or more biological parameters derived from a physiological sensor (e.g., a wearable device). The collected events are analyzed in block 62 to determine whether sufficient events have been collected to identify a sleep pattern within a predetermined degree of certainty. For example, in an embodiment, at least two weeks of sleep onset events are collected to identify a sleep pattern. In embodiments, the degree of certainty may be evaluated using any suitable technique, such as without limitation, events occurring within one standard deviation of the mean time of occurrence. A sleep pattern may indicate that, for example, on weekdays the sleep onset time is 10:00 PM and on weekends the sleep onset time is 11:30 PM. If a sleep pattern cannot be identified, the event collection continues at block 61.

If a sleep pattern is identified, then in block 63 the sleep onset time(s) become active and are entered into an HVAC setpoint schedule. In block 64, the HVAC sleep profile is initiated in advance of the scheduled sleep onset time in order to lead the occupants into sleep, and in block 65, the sleep profile is executed as described in detail above.

Figure 5:
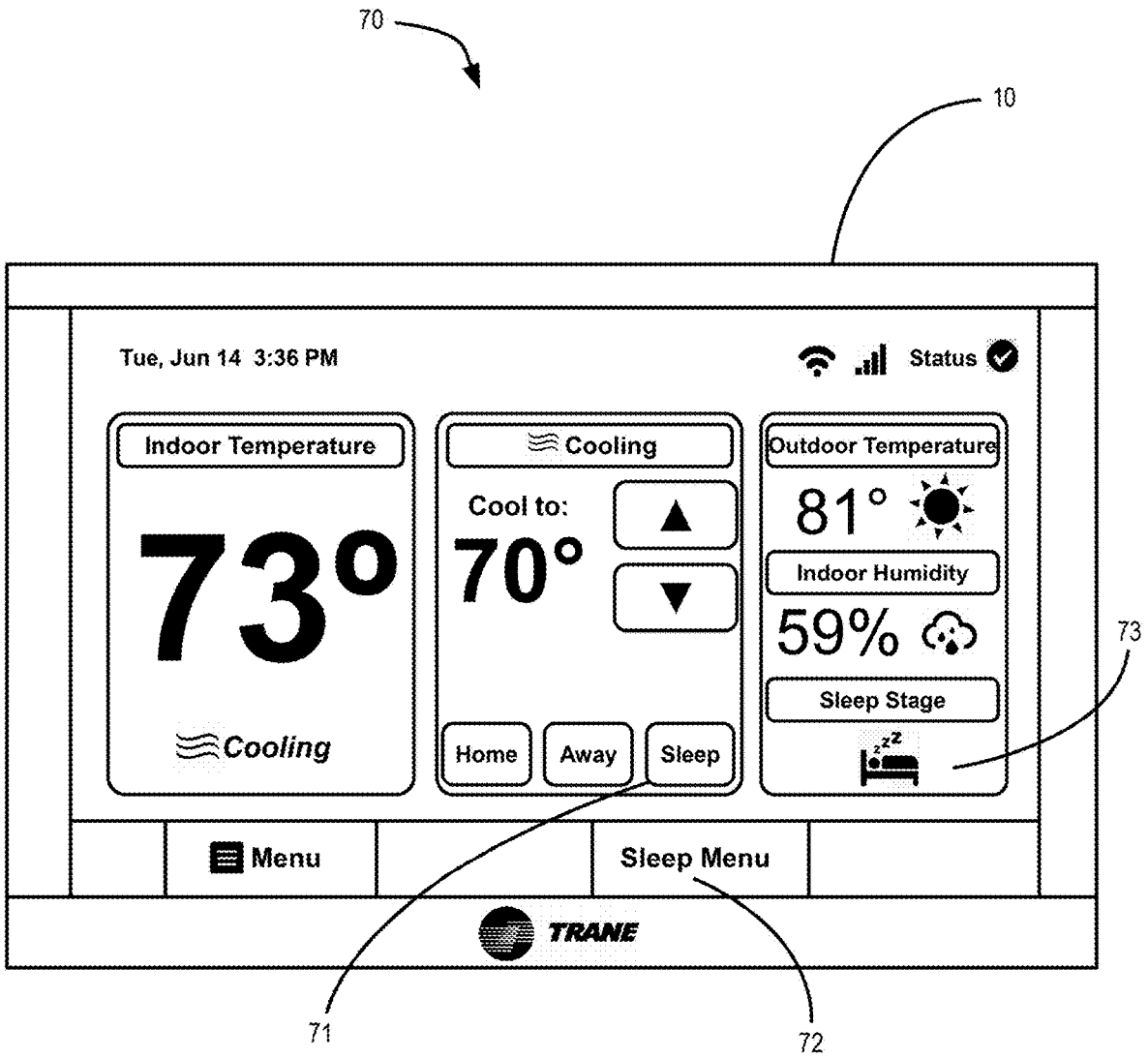
FIG. 5 is an exemplary user interface of a sleep-enhancing thermostat in accordance with the present disclosure.

FIG. 5 illustrates an example user interface 70 of thermostat 10. User interface 70 includes a sleep mode button 71 that may be actuated to manually enter into sleep mode; a sleep menu button 72 that may be actuated to enter or customize sleep mode parameters, such as, without limitation, the amount of sleep desired (in hours), duration of the aforementioned portions of the sleep profile (in relative or absolute terms), or modify sleep profile temperatures and/or rates. A sleep stage indicator 73 provides to non-sleeping users visual feedback of the current sleep enhancement status of HVAC system 1. Other UI elements may be advantageously employed to facilitate user input or feedback including without limitation, voice activation, speech synthesis, a smart phone application, tablet application, smart TV application, an Internet web portal, a motion/gesture sensor, and/or a proximity sensor.

Aspects

It is noted that any of aspects 1-20 may be combined with each other in any suitable combination.

Aspect 1. A sleep-enhancing method of operating an HVAC system, comprising determining the onset of a sleep time period and decreasing the target temperature of the HVAC system according to a temperature profile, wherein the temperature profile emulates the change in body temperature of a human being during the sleep time period.

Aspect 2. The method in accordance with aspect 1, further comprising increasing the target temperature of the HVAC system prior to the end of the sleep time period.

Aspect 3. The method in accordance with aspect 1 or 2, further enhancing sleep by commencing the lowering prior to the onset of the sleep time period to cause the temperature profile to lead the change in body temperature of a human being during the sleep time period.

Aspect 4. The method in accordance with any of aspects 1-3, wherein the temperature profile defines a plurality of consecutive sub-periods Aspect 5. The method in accordance with any of aspects 1-4, wherein during a first sub-period, the target temperature decreases at a first rate.

Aspect 6. The method in accordance with any of aspects 1-5, wherein during a second sub-period, the target temperature decreases at a second rate.

Aspect 7. The method in accordance with any of aspects 1-6, wherein during a third sub-period, the target temperature remains unchanged.

Aspect 8. The method in accordance with any of aspects 1-7, wherein during a fourth sub-period, the target temperature increases at a third rate.

Aspect 9. The method in accordance with any of aspects 1-8, wherein the determining is based on a schedule and/or an occupancy.

Aspect 10. The method in accordance with any of aspects 1-9, wherein the rate of change of the target temperature of the HVAC system is no more than about 0.025° C. per minute.

Aspect 11. A sleep-enhancing controller for an HVAC system, comprising a temperature sensor interface, an HVAC control interface, a processor in operative communication with the temperature sensor interface and the HVAC control interface, and a memory in operative communication with the processor including instructions, which, when executed by the processor, cause the sleep-enhancing controller to determine the onset of a sleep time period and decrease the target temperature of the HVAC system according to a temperature profile that emulates the change in body temperature of a human being during sleep.

Aspect 12. The controller in accordance with aspect 11, wherein the instructions further cause the sleep-enhancing controller to raise the target temperature of the HVAC system prior to the end of the sleep time period.

Aspect 13. The controller in accordance with aspect 11 or 12, wherein the instructions further cause the controller to commence lowering the target temperature prior to the onset of the sleep time period to cause the temperature profile to lead the change in body temperature of a human being during the sleep time period.

Aspect 14. The controller in accordance with any of aspects 11-13, wherein during a first portion of the sleep time period, the instructions cause the controller to decrease the target temperature at a first rate.

Aspect 15. The controller in accordance with any of aspects 11-14, wherein during a second portion of the sleep time period, the instructions cause the controller to decrease the target temperature at a second rate.

Aspect 16. The controller in accordance with any of aspects 11-15, wherein during a third portion of the sleep time period, the instructions cause the controller to maintain the target temperature unchanged.

Aspect 17. The controller in accordance with any of aspects 11-16, wherein during a fourth portion of the sleep time period, the instructions cause the controller to increase the target temperature at a third rate.

Aspect 18. The controller in accordance with claim any of aspects 11-17, wherein the instructions further cause the controller to determine the onset of the sleep time period based on a predetermined sleep schedule.

Aspect 19. The controller in accordance with any of aspects 11-18, further comprising an occupancy sensor interface in operable communication with the processor and wherein the instructions further cause the controller to determine an occupancy state based on a signal received from the occupancy sensor interface and to determine the onset of the sleep time period in response to the occupancy state.

Aspect 20. The controller in accordance with any of aspects 11-19, wherein the instructions further cause the controller to limit the rate of change of the target temperature of the HVAC system to no more than about 0.025° C. per minute.

Particular embodiments of the present disclosure have been described herein, however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in any appropriately detailed structure.

What is claimed is:

1. A method comprising:

controlling a heating, ventilation, and air conditioning (HVAC) system that is configured to provide conditioned air to an indoor environment of a room of a building, wherein the controlling controls a temperature of air of the indoor environment of the room by controlling a setpoint temperature of the conditioned air;

detecting a sleep onset event for an occupant of the building; and in response to the sleep onset event, accessing a sleep profile, wherein the setpoint temperature is initially set to a base setpoint temperature, execution of the sleep profile adjusts the setpoint temperature as a function of time over a time period, which comprises a target sleep period, by decreasing the setpoint temperature, at an onset of the time period, from the base setpoint temperature to a lower setpoint temperature, over a first period of time comprising one or more temperature decreasing portions, subsequent to the first period of time, sustaining the lower setpoint temperature during a temperature sustaining Portion of the time period, and subsequent to the temperature sustaining portion of the time period, increasing the setpoint temperature from the lower setpoint temperature to the base setpoint temperature, over a second period of time comprising one or more temperature increasing portions, and the target sleep period comprises a portion of one of the temperature decreasing portions, the temperature sustaining portion, and a portion of one of the temperature increasing portions, and executing the sleep profile.

2. The method of claim 1, wherein an indoor environment of the building comprises the indoor environment of the room, and the detecting the sleep onset event comprises receiving one or more environmental conditions of the indoor environment of the building from one or more sensors; and detecting the sleep onset event from the one or more environmental conditions.

3. The method of claim 2, wherein the building comprises another room, the one or more sensors are placed in the another room, and the one or more environmental conditions comprise at least one of motion, occupancy, or carbon dioxide level in an indoor environment of the another room.

4. The method of claim 1, wherein the sleep onset event is determined based, at least in part, on a predetermined sleep schedule, and the predetermined sleep schedule is based, at least in part, on at least one of a historical physiological sensor input or a historical environmental sensor input.

5. The method of claim 1, further comprising:

collecting a plurality of onset-indicative events, prior to the time period;

determining whether a sleep pattern can be identified, using the plurality of onset-indicative events;

in response to a determination that the sleep pattern can be identified, identifying the sleep pattern using the plurality of onset-indicative events, wherein the sleep pattern comprises a sleep onset, producing a modified scheduled sleep onset time by modifying a scheduled sleep onset time based, at least in part, on the sleep onset, wherein the scheduled sleep onset time is a time-of-day defined in the sleep profile, and causing initiation of the executing the sleep profile using the modified scheduled sleep onset time, in advance of the scheduled sleep onset time; and in response to a determination that the sleep pattern cannot be identified, collecting one or more additional onset-indicative events.

6. The method of claim 5, wherein the sleep profile is configured such that the sustaining of the setpoint temperature at the lower setpoint temperature begins at completion of a last temperature decreasing portion of the one or more temperature decreasing portions prior to the temperature sustaining portion, and the increasing the setpoint temperature from the lower setpoint temperature to the base setpoint temperature is initiated at completion of the temperature sustaining portion of the time period, the decreasing the setpoint temperature accelerates a rate of decrease in the setpoint temperature from a first rate of decrease during a first one of the one or more temperature decreasing portions to a second rate of decrease during a second one of the one or more temperature decreasing portions, and the first one of the one or more temperature decreasing portions precedes the second one of the one or more temperature decreasing portions.

7. The method of claim 1, wherein the decreasing the setpoint temperature accelerates a rate of decrease in the setpoint temperature from a first rate of decrease during a first one of the one or more temperature decreasing portions to a second rate of decrease during a second one of the one or more temperature decreasing portions, the first one of the one or more temperature decreasing portions precedes the second one of the one or more temperature decreasing portions in the sleep profile, the increasing the setpoint temperature accelerates a rate of increase in the setpoint temperature from a first rate of increase during a first one of the one or more temperature increasing portions to a second rate of increase during a second one of the one or more temperature increasing portions, and the first one of the one or more temperature increasing portions precedes the second one of the one or more temperature increasing portions in the sleep profile.

8. The method of claim 1, wherein the building comprises a plurality of rooms, the plurality of rooms comprises the room, the occupant is one of a plurality of occupants of the building, each room of the plurality of rooms corresponds to a corresponding one of the plurality of occupants, and the method further comprises collecting one or more physiologic inputs for each of the plurality of occupants, for the each room of the plurality of rooms, adjusting a corresponding setpoint temperature for the each room of the plurality of rooms according to a corresponding sleep profile of a plurality of sleep profiles, wherein the corresponding sleep profile corresponds to the each of the plurality of occupants corresponding to the each room of the plurality of rooms, and a sleep onset of the corresponding sleep profile is based, at least in part, on the one or more physiologic inputs for the each of the plurality of occupants corresponding to the each room of the plurality of rooms.

9. The method of claim 7, further comprising:

determining an end of the target sleep period, wherein the rate of increase of the setpoint temperature accelerates from the first rate of increase to the second rate of increase at the end of the target sleep period.

10. The method of claim 7, wherein the rate of increase in the setpoint temperature and the rate of decrease in the setpoint temperature are no more than 0.025° Celsius per minute.

11. A controller comprising:

a memory configured to store instructions; and a processor configured to access the memory and execute the instructions to cause the controller to at least:

control a heating, ventilation, and air conditioning (HVAC) system that is configured to provide conditioned air to an indoor environment of a room of a building, wherein a temperature of air of the indoor environment of the room is controlled by controlling a setpoint temperature of the conditioned air, detect a sleep onset event for an occupant of the building, and in response to the sleep onset event, access a sleep profile, wherein the setpoint temperature is initially set to a base setpoint temperature, execution of the sleep profile adjusts the setpoint temperature as a function of time over a time period, which comprises a target sleep period, by decreasing the setpoint temperature, at an onset of the time period, from the base setpoint temperature to a lower setpoint temperature, over a first period of time comprising one or more temperature decreasing portions, subsequent to the first period of time, sustaining the lower setpoint temperature during a temperature sustaining portion of the time period, and subsequent to the temperature sustaining portion of the time period, increasing the setpoint temperature from the lower setpoint temperature to the base setpoint temperature, over a second period of time comprising one or more temperature increasing portions, and the target sleep period comprises a portion of one of the temperature decreasing portions, the temperature sustaining portion, and a portion of one of the temperature increasing portions, and execute the sleep profile.

12. The controller of claim 11, wherein an indoor environment of the building comprises the indoor environment of the room, and the instructions to cause the controller to detect the sleep onset event comprise further instructions to cause the controller to receive one or more environmental conditions of the indoor environment of the building from one or more sensors; and detect the sleep onset event from the one or more environmental conditions.

13. The controller of claim 12, wherein the building comprises another room, the one or more sensors are placed in the another room, and the one or more environmental conditions comprise at least one of motion, occupancy or carbon dioxide level in an indoor environment of the another room.

14. The controller of claim 11, wherein the instructions to cause the controller to detect the sleep onset event comprise further instructions to:

determine the sleep onset event based, at least in part, on a predetermined sleep schedule.

15. The controller of claim 11, wherein the instructions are further configured to cause the controller to:

collect a plurality of onset-indicative events, prior to the time period;

determine whether a sleep pattern can be identified, using the plurality of onset-indicative events;

in response to a determination that the sleep pattern can be identified, identify the sleep pattern using the plurality of onset-indicative events, wherein the sleep pattern comprises a sleep onset, produce a modified scheduled sleep onset time by modifying a scheduled sleep onset time based, at least in part, on the sleep onset, wherein the scheduled sleep onset time is a time-of-day defined in the sleep profile, and cause initiation of the execution of the sleep profile using the modified scheduled sleep onset time, in advance of the scheduled sleep onset time; and in response to a determination that the sleep pattern cannot be identified, collect one or more additional onset-indicative events.

16. The controller of claim 15, wherein the sleep profile is configured such that the sustaining of the setpoint temperature at the lower setpoint temperature begins at completion of a last temperature decreasing portion of the one or more temperature decreasing portions prior to the temperature sustaining portion, and the increasing the setpoint temperature from the lower setpoint temperature to the base setpoint temperature is initiated at completion of the temperature sustaining portion of the time period, the decreasing the setpoint temperature accelerates a rate of decrease in the setpoint temperature from a first rate of decrease during a first one of the one or more temperature decreasing portions to a second rate of decrease during a second one of the one or more temperature decreasing portions, and the first one of the one or more temperature decreasing portions precedes the second one of the one or more temperature decreasing portions.

17. The controller of claim 11, wherein the decreasing the setpoint temperature accelerates a rate of decrease in the setpoint temperature from a first rate of decrease during a first one of the one or more temperature decreasing portions to a second rate of decrease during a second one of the one or more temperature decreasing portions, the first one of the one or more temperature decreasing portions precedes the second one of the one or more temperature decreasing portions in the sleep profile, the increasing the setpoint temperature accelerates a rate of increase in the setpoint temperature from a first rate of increase during a first one of the one or more temperature increasing portions to a second rate of increase during a second one of the one or more temperature increasing portions, and the first one of the one or more temperature increasing portions precedes the second one of the one or more temperature increasing portions in the sleep profile.

18. The controller of claim 11, wherein the building comprises a plurality of rooms, the plurality of rooms comprises the room, the occupant is one of a plurality of occupants of the building, each room of the plurality of rooms corresponds to a corresponding one of the plurality of occupants, and the instructions are further configured to cause the controller to collect one or more physiologic inputs for each of the plurality of occupants, for the each room of the plurality of rooms, adjust a corresponding setpoint temperature for the each room of the plurality of rooms according to a corresponding sleep profile of a plurality of sleep profiles, wherein the corresponding sleep profile corresponds to the each of the plurality of occupants corresponding to the each room of the plurality of rooms, and a sleep onset of the corresponding sleep profile is based, at least in part, on the one or more physiologic inputs for the each of the plurality of occupants corresponding to the each room of the plurality of rooms.

19. The controller of claim 17, wherein the instructions are further configured to cause the controller to:

determine an end of the target sleep period, wherein the rate of increase of the setpoint temperature accelerates from the first rate of increase to the second rate of increase at the end of the target sleep period.

20. The controller of claim 17, wherein the rate of increase in the setpoint temperature and the rate of decrease in the setpoint temperature are no more than 0.025° Celsius per minute.

* * * * *